US005385697A

United States Patent [19]

Jenson

[11] Patent Number: 5,385,697

[45] Date of Patent: Jan. 31, 1995

[54] CARBURETOR FLOAT AND METHOD OF FORMING SAME

[76] Inventor: Randy P. Jenson, 13012 2nd St. SE., Lake Stevens, Wash. 98258

[21] Appl. No.: 138,698

[22] Filed: Oct. 18, 1993

[51] Int. Cl.[6] ..... F02M 5/16

[52] U.S. Cl. ..... 261/70; 137/445; 264/DIG. 76

[58] Field of Search ..... 261/70; 137/434, 445; 264/DIG. 76

[56] References Cited

U.S. PATENT DOCUMENTS

| | | | |
|---|---|---|---|
| 1,743,791 | 1/1930 | Mock | 261/70 |
| 1,927,426 | 9/1933 | Wahlmark | 261/62 |
| 1,933,360 | 10/1933 | Barbarou | 137/104 |
| 2,503,036 | 4/1950 | Fricke et al. | 137/104 |
| 2,575,251 | 11/1951 | Arnold | 264/DIG. 76 |
| 2,694,469 | 11/1954 | Peck | 137/434 |
| 3,038,706 | 6/1962 | Ball | 261/23.2 |
| 3,208,738 | 9/1965 | Johnson | 261/23.2 |
| 3,382,881 | 5/1968 | Charron | 137/39 |
| 3,661,172 | 5/1972 | Miller | 137/434 |
| 4,034,026 | 7/1977 | Miller | 261/23 |
| 4,100,232 | 7/1978 | Kaye | 261/36 |
| 4,383,952 | 5/1983 | Montefameglio et al. | 261/72 |
| 4,513,725 | 4/1985 | Minami et al. | 123/511 |

FOREIGN PATENT DOCUMENTS

| | | | |
|---|---|---|---|
| 2735363 | 2/1979 | Germany | 261/70 |
| 543166 | 5/1956 | Italy | 261/70 |
| 0083555 | 7/1981 | Japan | 261/70 |
| 0190653 | 9/1985 | Japan | 261/70 |
| 0193070 | 8/1989 | Japan | 261/70 |

*Primary Examiner*—Tim Miles

*Attorney, Agent, or Firm*—David P. Campbell

[57] ABSTRACT

A carburetor float (10) having a body portion (12) with at least one divider wall (26, 27) formed therein, a lid (4) for closing off the top of the body portion and for sealing the interior chamber of the body portion and for sealing the cells (30, 31, 32) within the body portion from each other, and a mounting bracket (36) extending from an upper edge of one side of the body portion of the carburetor float for receiving a spring clip (16) that controls the inlet valve to the float bowl of the carburetor.

13 Claims, 11 Drawing Sheets

Fig. 16
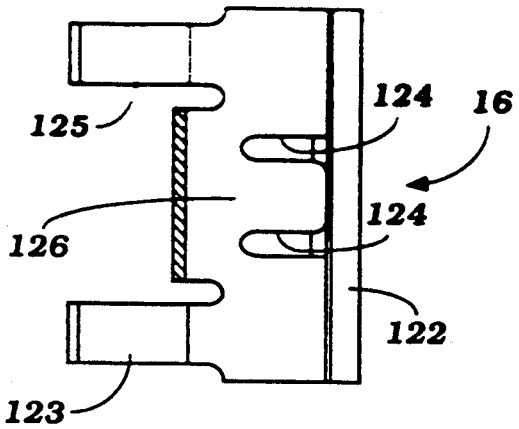
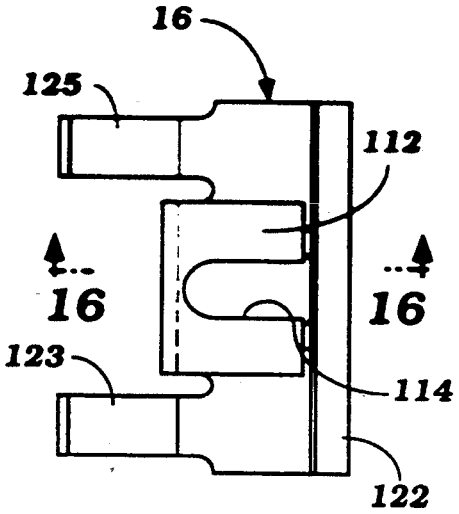
Fig. 14
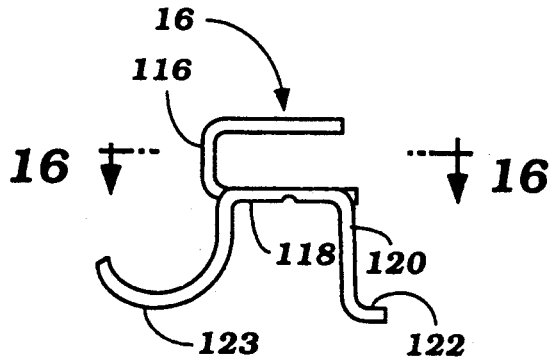
Fig. 15
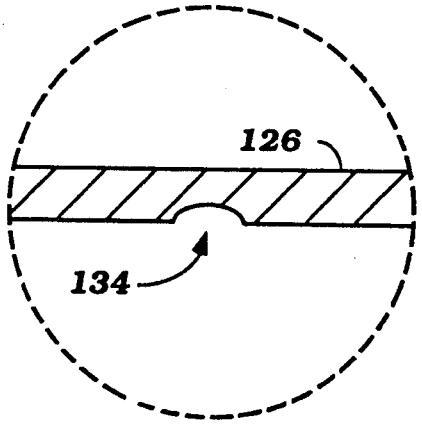
Fig. 18
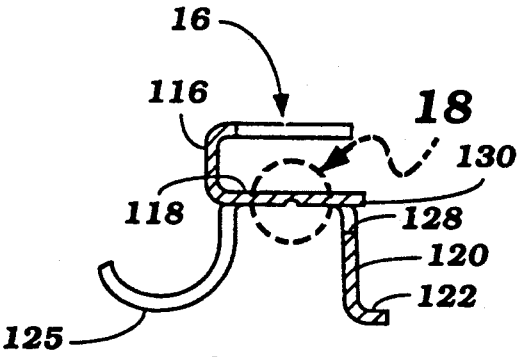
Fig. 17

CARBURETOR FLOAT AND METHOD OF FORMING SAME

TECHNICAL FIELD

This invention pertains to carburetor floats and, more particularly, to improved carburetor floats for internal combustion aircraft engines, each float characterized by a multi-cell pontoon.

BACKGROUND OF THE INVENTION

It is well known that in the fuel delivery system of an internal combustion aircraft engine, the carburetor produces an appropriate air/fuel mixture for delivery to the combustion chambers of the engine. The carburetor float maintains a predetermined level of fuel in a float bowl, which is positioned between the fuel inlet to the carburetor and the fuel discharge nozzle in the induction passage of the carburetor. The fuel level in the float bowl provides a uniform fuel head for the fuel discharge nozzle at the induction passage. Within the float bowl, the carburetor float is coupled to a needle valve in a pivoting relationship to control the level of fuel within the float bowl.

Typical prior art carburetor floats include metal thin-walled pontoons which are hollow and are intended to be liquid tight. A problem with these pontoons is that they malfunction when a leak develops and fuel seeps into the interior chamber of the pontoon. When this happens, the pontoon loses buoyancy and cannot function properly to control the fuel level in the float bowl. As a result, an improper air/fuel mixture is delivered to the combustion chambers of the engine. An improper air/fuel mixture adversely affects the performance of an aircraft engine and sometimes can lead to engine failure.

Hollow metal pontoons tend to leak at their joints where voids or imperfections are created during manufacture or by erosion.

Some metal pontoons are foam filled to provide strength for higher pressure fuel distribution systems. Other known carburetor floats include pontoons made from a solid foam plastic or other lightweight float material encased by a skin that is intended to be impervious to liquid. These foam-type pontoons, generally, are lighter than hollow metal pontoons.

At times, holes develop in the skin material. This allows fuel to enter the pontoon and "log" the foam body causing it to lose buoyancy.

Accordingly, it is an object of the present invention to provide an improved carburetor float that, if subject to a leak, will continue to function properly to control the level of fuel in the float bowl.

In addition, the present invention seeks to alleviate the excessive wear that occurs at the contact point between the float and the needle valve of the carburetor and at the pivot point of the carburetor.

DISCLOSURE OF THE INVENTION

Briefly described, the present invention comprises an improved carburetor float for a carburetor that is part of a fuel delivery system in an internal combustion engine. The carburetor includes a float bowl, and a float-controlled valve extending into the float bowl for metering the flow of fuel into the float bowl. The carburetor float is pivotally secured in engagement with the float-controlled valve and is responsive to the level of fuel in the float bowl. The carburetor float includes a hollow pontoon defining a sealed interior chamber. The hollow, sealed pontoon of the carburetor float gives the float buoyancy so that the float rides at the level of the fuel in the float bowl of the carburetor and functions to control the opening and closing of a float-controlled needle valve in response to changes in the level of fuel in the float bowl. The interior chamber of the pontoon is provided with at least one divider wall for dividing the interior chamber into at least two cells that are sealed from each other and from the fuel in the float bowl.

A spring clip is mounted to the hollow body for pivotally securing the carburetor float in engagement with the float-controlled valve. The spring clip engages the float control valve. The carburetor float is pivotally mounted within the float bowl and rests at the level of the fuel in the float bowl. As the level of fuel in the float bowl changes, the carburetor float pivots in response to the changing level of fuel in the float bowl, causing the spring clip to open and close the float-controlled needle valve. The spring clip is made of stainless steel, as opposed to brass, from which many prior art spring clips are made. Stainless steel substantially reduces the wear between the clip and the float-controlled needle valve.

The carburetor float of the present invention is designed specifically for air cooled, opposed aircraft engines. However, the present invention can be applied to many types of internal combustion engines used in other types of aircraft, as well as in motorized vehicles and other applications.

Preferably, two or more divider walls are provided to divide the interior chamber into a plurality of cells. The cellular design of the interior chamber provides a fail-safe design in that one cell can fill with fuel upon the formation of a leak, while the other cells remain sealed, and the carburetor float can continue to function.

The improved carburetor float is formed by injection molding the pontoon from a thermoplastic material. The pontoon is formed from two parts, a base portion and a lid for closing off the base. The base portion is formed with the divider walls therein for dividing the interior chamber of the base into a plurality of cells. The lid includes a groove along the outer peripheral rim of the lid. The groove fits over the upper edge of the walls of the base portion of the float in a tongue-and-groove fit. The lid also includes a divider rib for each divider wall. Each divider rib includes a groove for receiving the upper edge of a divider wall in a tongue-and-groove arrangement so that a sealed cellular arrangement is formed upon attachment of the lid to the base portion. The lid and the base portion are mounted to each other by means of an ultrasonic welding process wherein an ultrasonic frequency is passed through the thermoplastic material of the lid and the body, causing the tongue-and-groove-engagement of the rim of the lid and the upper edge of the body to fuse together.

The provision of a lid and main body portion positions the weld seam near the upper portion of the pontoon, above the level of fuel in the float bowl. This design reduces the potential for leakage should the integrity of the weld seam be damaged.

The body portion of the carburetor float includes a mounting bracket extending from the upper edge of one side of the body. The mounting bracket is also injection molded along with the body portion. The mounting bracket includes a tubular bushing for receiving a pivotal support for securing the carburetor float within the float bowl. The plastic tubular bushing substantially reduces wear at the pivot point of the carburetor float. The tubular bushing also is designed to receive a sleeve bushing made of material more durable than plastic if a particular application so requires.

The mounting bracket carries the spring clip. The spring clip includes a lower flange formed at the lower leading edge of the spring clip. The flange is captured between the mounting bracket and the outer rim portion of the lid of the carburetor float when the lid and the base portion of the pontoon are ultrasonically welded together. The mounting arrangement for the spring clip allows the spring clip to be made from a metal material while the carburetor float is made from a lighter thermoplastic material. With this design, a sealed, cellular carburetor float made from lightweight thermoplastic material can be utilized in combination with a stainless steel spring clip for controlling the operation of the inlet valve.

The spring clip includes an adjustable tab for adjusting the distance between the spring clip and the head of the inlet valve. Adjustment of the adjustable tab changes the required fuel level in the float bowl for closing off the inlet valve. The adjustable tap, per se, is not new. However, the cellular, thermoplastic design for the carburetor float of the present invention allows the spring clip to utilize an adjustable tab for controlling the fuel level in the float bowl.

Other advantages, features and objects of the present invention will become apparent from the following description of the best mode and the accompanying drawings and the claims, which all are incorporated herein by reference as part of the disclosure of the invention.

BRIEF DESCRIPTION OF THE DRAWINGS

In the drawings, like reference numerals are used to designate like parts throughout the several views, and:

FIG. 14 is a plan view of the spring clip of the carburetor float of FIG. 1;

FIG. 15 is a side elevation view of the spring clip of Fig.

FIG. 16 is a top view of the spring clip taken along the line 16—16 of FIG. 15;

FIG. 17 is a cross-sectional view of the spring clip taken along the line 17—17 of FIG. 14;

FIG. 18 is a detailed view of the adjustable tab of the spring clip of FIG. 17;

BEST MODE FOR CARRYING OUT THE INVENTION

Figure 1:
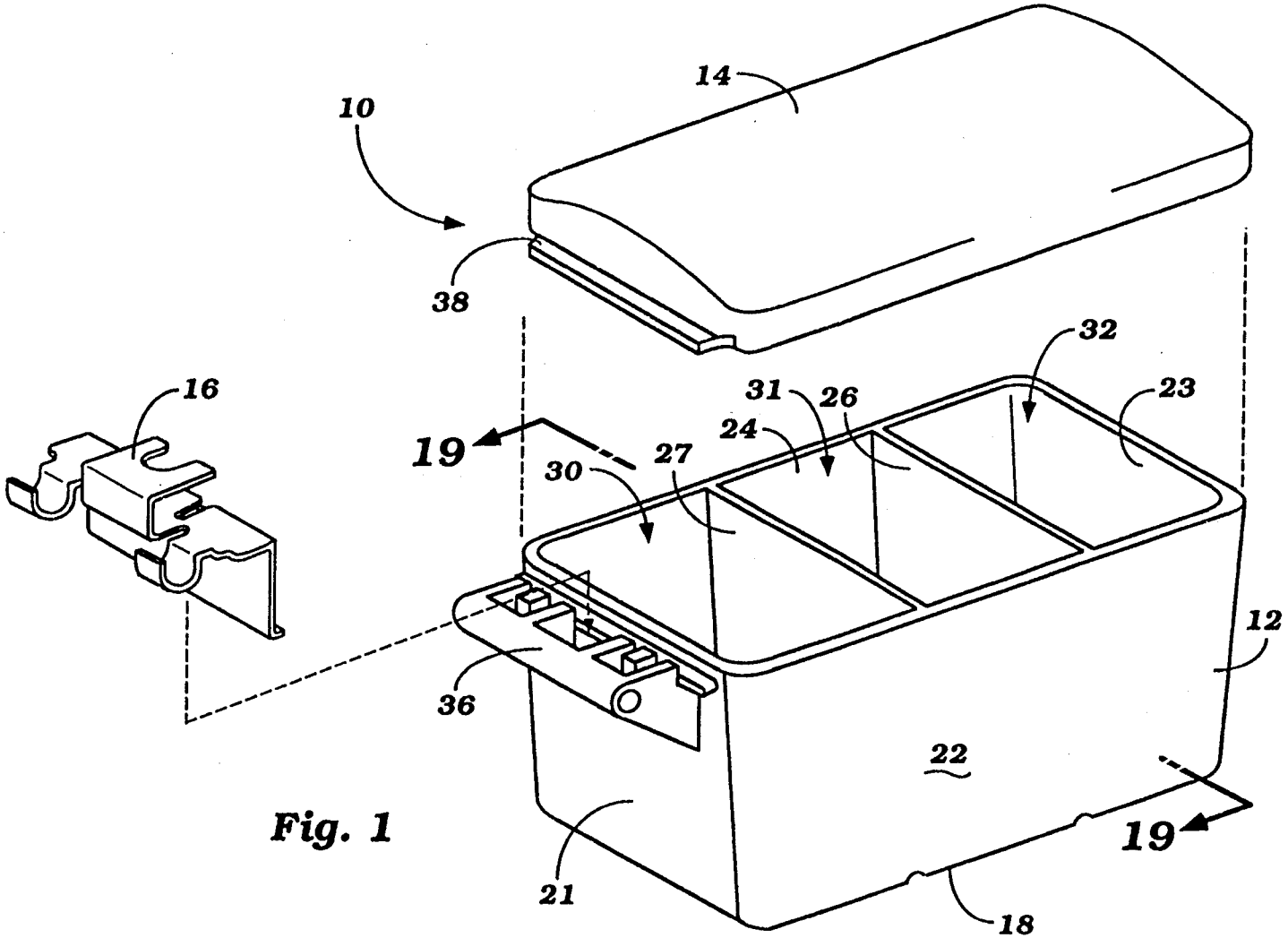
FIG. 1 is an exploded pictorial view of an embodiment of the carburetor float of the present invention.

Referring now to the drawings, the carburetor float 10 includes a generally rectangular main body 12, a lid 14, and a spring clip 16. The rectangular main body 12 and the lid 14 together form a "pontoon".

The rectangular main body 12 is a hollow structure formed by a base 18 and four sidewalls 21, 22, 23, 24. The main body 12 has an open top that is sealed off by lid 14. Divider walls 26, 27 extend the height of the main body 12 and divide its interior into separate cells 30, 31, 32. A mounting bracket 36 is formed along the upper portion of sidewall 21 of the main body 12 for mounting the spring clip 16 to the main body 12 and lid 14. The left edge of the lid 14 (as shown in FIG. 1) includes a flange or rim 38.

Figure 2:
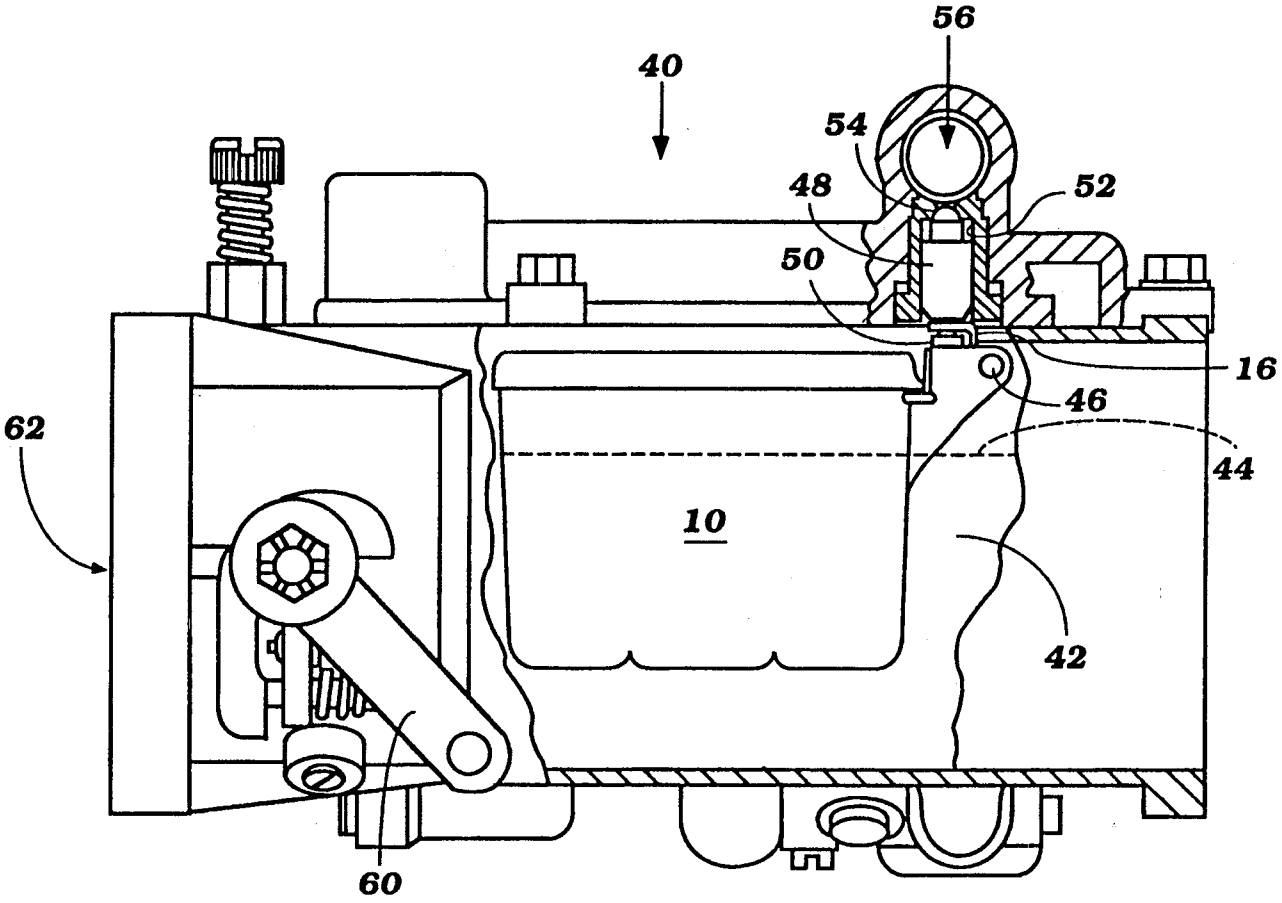
FIG. 2 is a side elevation view of a carburetor including the carburetor float of FIG. 1 shown partially cut away to illustrate the components of the carburetor.

FIG. 2 is a side elevation view of an aircraft carburetor 40 shown partially cut away. The aircraft carburetor 40 includes a float bowl 42 in which the pontoon of the carburetor float 10 floats at fuel level 44. The carburetor float 10 is pivotally secured to the body of the carburetor 40 at pivot point 46. A needle valve 48 having a needle head 50 is disposed within a float valve chamber 52. The spring clip 16 of the carburetor float 10 clasps the needle head 50. The needle valve 48 closes off a valve seat 54 at the upper end of the float valve chamber 52 to meter the flow of fuel from the fuel inlet 56 into the float bowl 42. A throttle valve is controlled by a throttle linkage 60. The throttle valve is positioned within an induction passage 62, as is well known in the art. The particular aircraft carburetor 40 shown in FIG. 2 is a Model HA-6 type aircraft carburetor manufactured by Precision Airmotive Corporation, Everett, Wash. U.S.A.

Figures 3, 4, 5, 6, 7, 8:
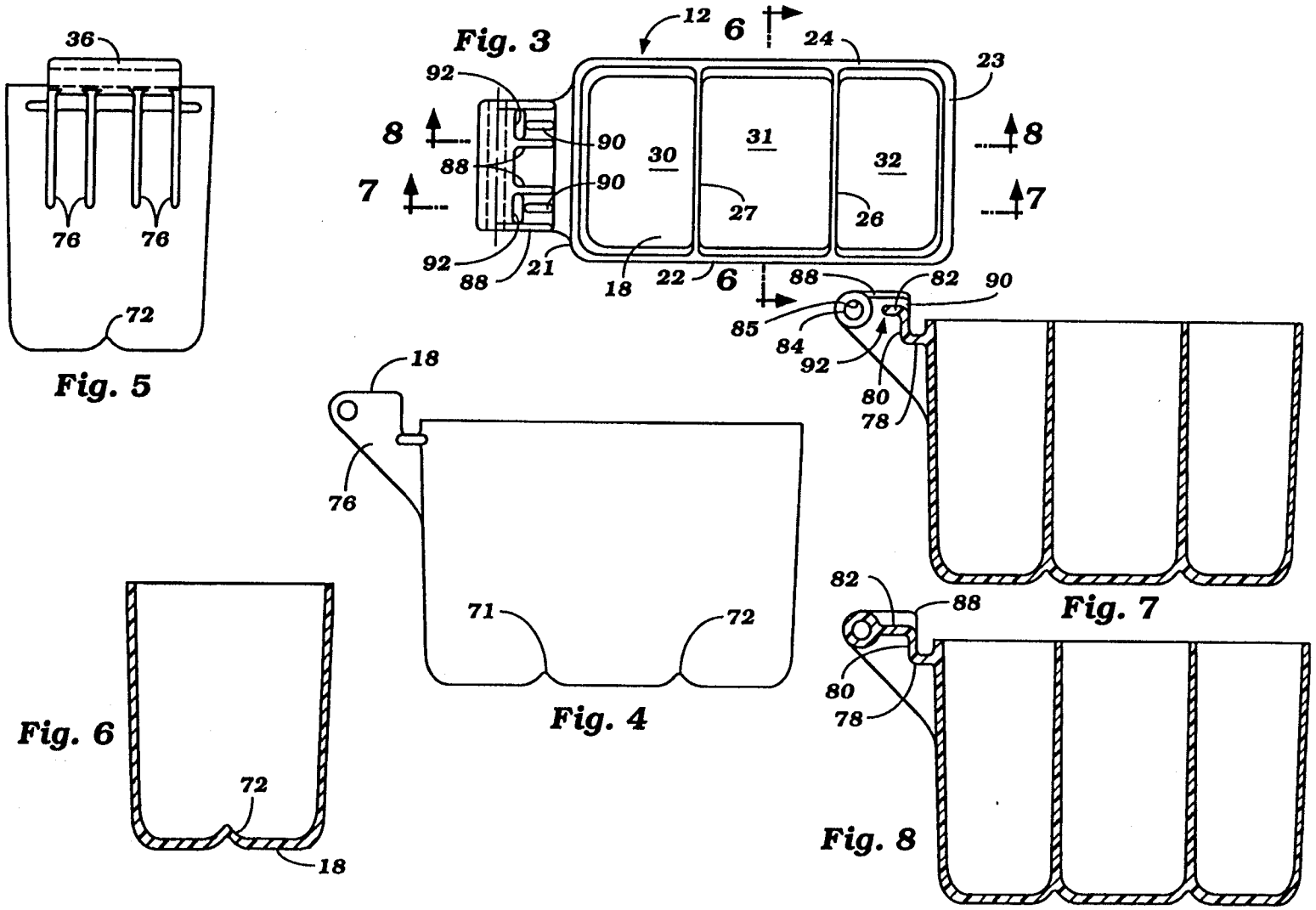
FIG. 3 is a plan view of a main body portion of the pontoon of FIG. 1.
FIG. 4 is a side elevation view of the main body of the pontoon of FIG. 3.
FIG. 5 is a rear elevation view of the main body of the pontoon of FIG. 3.
FIG. 6 is a cross-sectional view of the main body of the pontoon taken along the line 6—6 of FIG. 3.
FIG. 7 is a cross-sectional view of the main body of the pontoon taken along the line 7—7 of FIG. 3.
FIG. 8 is a cross-sectional view of the main body of the pontoon taken along the line 8—8 of FIG. 3.
Figure 9:
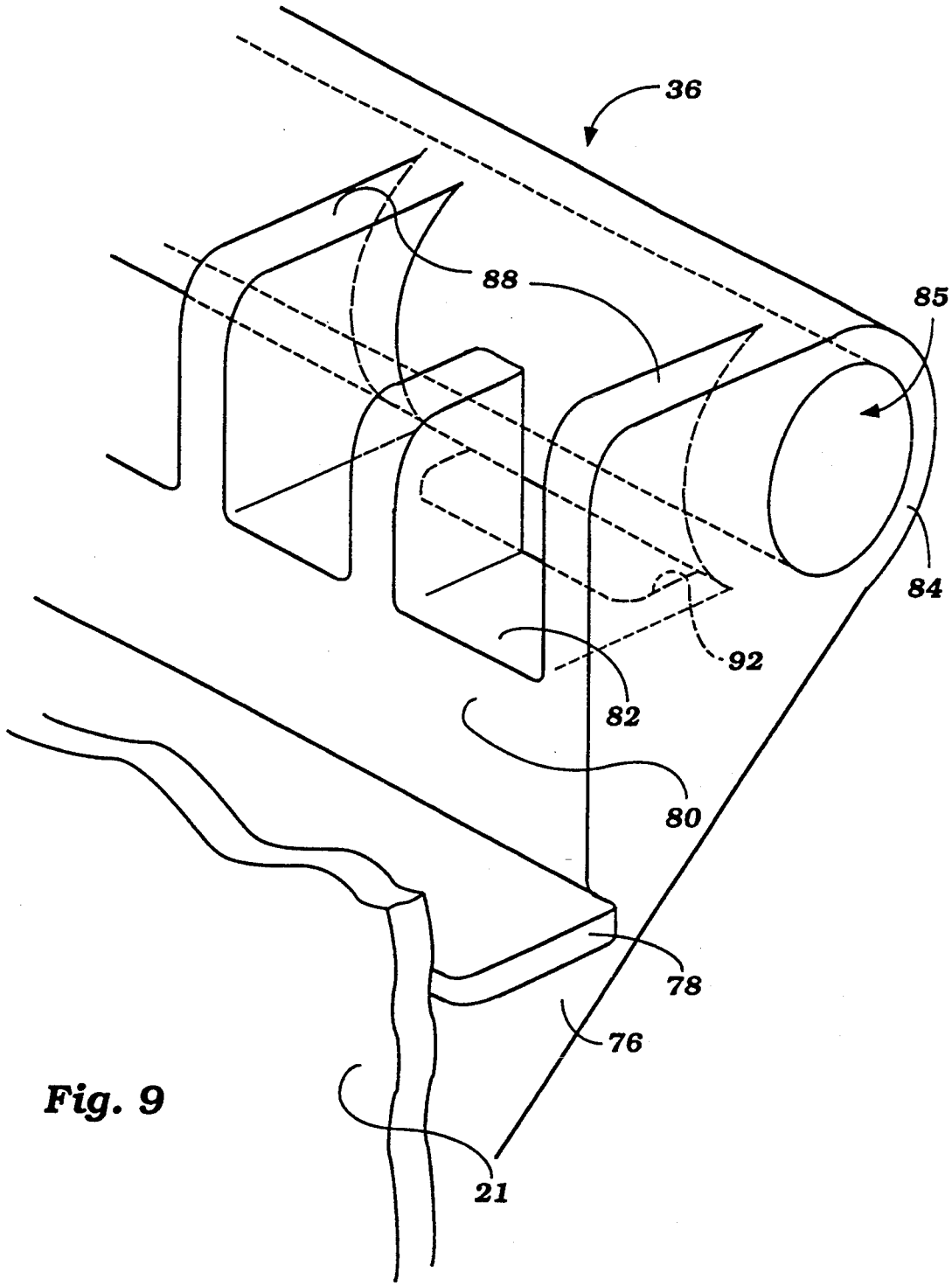
FIG. 9 is an isometric view of the mounting bracket of the pontoon of FIG. 1.
Figure 13:
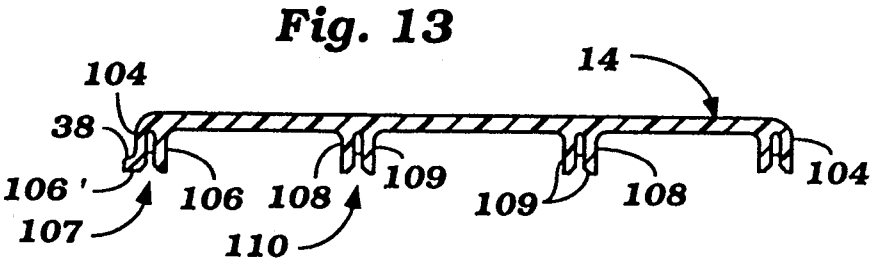
FIG. 13 is a cross-sectional view of the lid taken along the line 13—13 of FIG. 10.

FIGS. 3–9 illustrate the design of the rectangular main body 12 of the carburetor float. As shown in FIG. 3, the main body 12 includes a base 18, four sidewalls 21, 22, 23, 24, and a pair of divider walls 26, 27 dividing the interior of the main body 12 into three cells 30, 31, 32. Two divider walls 26, 27 are shown in FIG. 3. However, more than two divider walls may be provided for, creating a plurality of cells. The walls, 21, 22, 23, 24 of the main body 12 converge slightly toward each other at the base 18, as illustrated in FIGS. 4–8. The bottom edges and corners of the main body 12 are rounded, as shown in several of the views. The base 18 includes a pair of ridges 70, 71, as indicated in FIG. 4, which extend laterally across the base 18 and are positioned at the divider walls 26, 27. In addition, a ridge 72 runs longitudinally along the base 18 between sidewalls 21 and 23, as indicated in FIGS. 5 and 6.

As best shown in FIGS. 3, 7, 8, and 9, the mounting bracket 36 is mounted to the upper portion of sidewall 21. The mounting bracket 36 includes four vertical braces 76, which support a bottom horizontal segment 78 extending outwardly from the sidewall 21 (shown partially cut away), a vertical segment 80 extending upwardly from the horizontal segment 78, and an upper horizontal portion 82 that extends outwardly from the vertical segment 80. A cylindrical bushing 84 is formed at the outer edge of the upper horizontal portion 82. Cylindrical bushing 84 forms a passageway 85 for receiving a pivot pin. The braces 76 include lateral support ridges 88. Support ridges 90 form a seat for the spring clip and are positioned on the upper horizontal portion 82 midway between the lateral supports 88. The upper horizontal portion 82 includes a pair of transverse slots 92.

The entire main body 12, including mounting bracket 36, is formed by a process of injection molding a thermoplastic material, such as Fortron TM polyphenylene sulfide (PPS), manufactured by Hoechst Celanese Corporation, Chatham, N.J. U.S.A. Fortron TM PPS is a high performance thermoplastic material that is suitable for carburetor floats.

Figure 10:
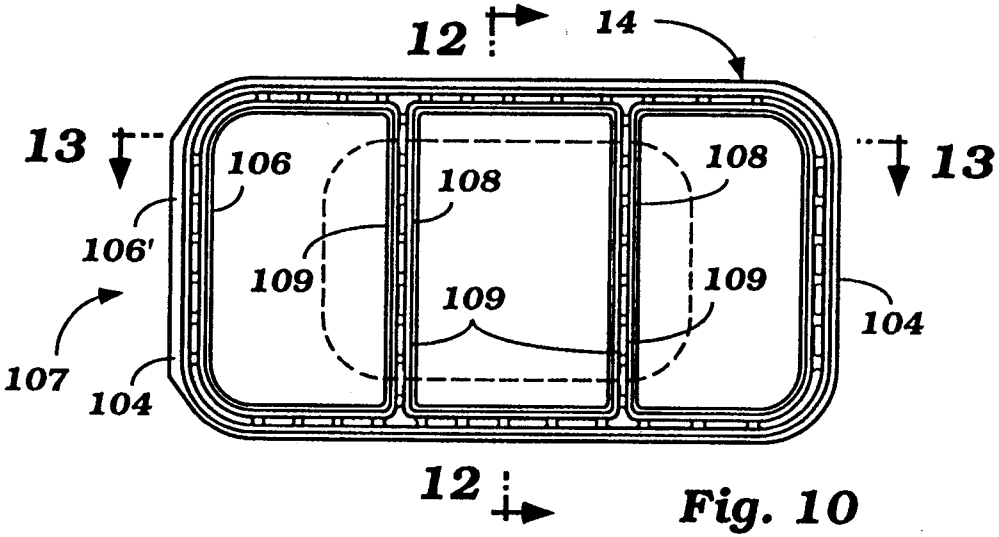
FIG. 10 is an underside view of the lid of the pontoon of FIG. 1.
Figure 11:
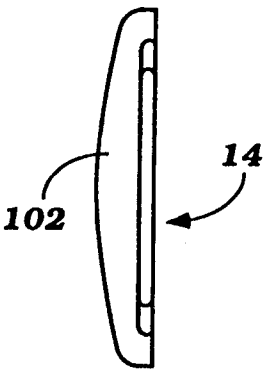
FIG. 11 is a side elevation view of the lid of FIG. 10.
Figure 12:
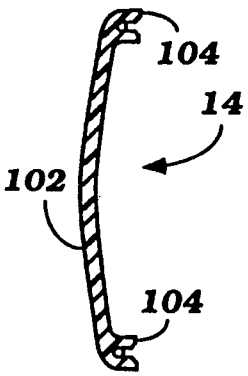
FIG. 12 is a cross-sectional of the lid view taken along the line 12—12 of FIG. 10.

FIGS. 10–13 illustrate the design of the lid 14 of the carburetor float. The lid 14 has a curved top portion 102, as shown in FIGS. 10 and 11. A rim 104 depends downwardly from the outer peripheral edges of the top portion 102. The rim 104 is formed by a pair of ridges 106, see FIG. 13, that define a groove 107 therebetween. Rim 38 extends from the lower edge of ridge 106'. A pair of divider rims 108 extend between the longitudinal side edges of the lid 14. Each divider rim 108 is formed by a pair of ridges 109 that define a groove 110 therebetween. Divider rims 108 are positioned in alignment with the divider walls 26, 27 of the main body 12 of the carburetor float. The lid 14 is also injection molded of thermoplastic material in a manner similar to that of the main body 12. The lid is secured onto the top of the main body 12 in a manner discussed later.

FIGS. 14–18 illustrate the design of the spring clip 16. As shown in FIG. 14, the spring clip 16 includes an upper clamp 112 having a slot 114 therein. The upper clamp 112 is supported by a vertical segment 116, as shown in FIG. 15. The vertical segment 116 rises from the back edge of an upper horizontal section 118. A vertical segment 120 depending from the forward edge of the horizontal section 118. The vertical segment 120 has a lower flange 122 extending forwardly thereof. A pair of semicircular arms 123, 125 extend downwardly from the back edge of the upper horizontal section 118.

The upper horizontal section 118 is provided with a pair of parallel slots 124, as shown in FIG. 16. Slots 124 create a tab 126 that is angularly adjustable in a manner described later. The portion of the vertical segment 120 below the adjustable tab 126 is cut away, as shown at 128 in FIG. 17. This allows the forward edge 130 of the adjustable tab 126 to be angularly adjusted downwardly for reasons discussed later. As detailed in FIG. 18, the rear portion of the adjustable tab 126 is provided with a coined groove 134 on the underside of the tab, which groove provides a point of deflection for the tab 126.

Figures 19, 20:
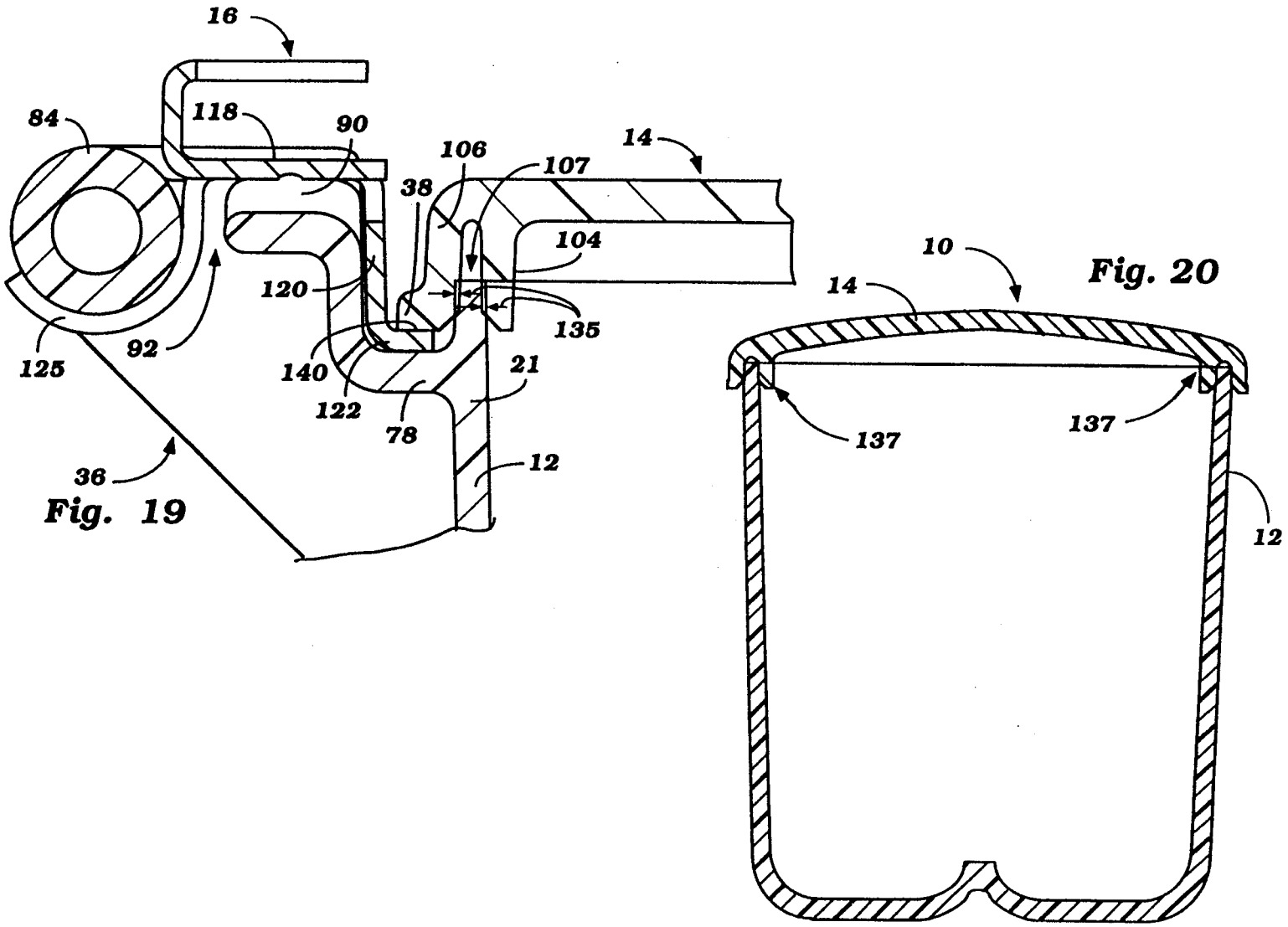
FIG. 19 is a fragmentary detail view of the mounting arrangement for the lid, the main body, and spring clip of the pontoon of FIG. 1.
FIG. 20 is a cross-sectional view of the main body and lid of the pontoon of FIG. 1.

FIG. 19 is a detailed view of the mounting arrangement of the spring clip 16 to the main body 12 and lid 14 of the carburetor float. The vertical section 120 of the spring clip 16 and its lower flange 122 are captured between the lower rim 38 of the outside ridge 106 of the rim 104 that extends around the side wall 21 of the main body 12 of the carburetor float. The upper horizontal section 118 of the spring clip 16 is supported by the support ridges 90 of the mounting bracket 36. The semicircular arms 123, 125 of the spring clip extend through the slots 92 and downwardly around the bottom half of the cylindrical bushing 84 of the mounting bracket 36.

The lid 14 is mounted onto the main body 12 so that the upper edges of the side walls 21, 22, 23, 24 of the main body 12 are partially captured within the grooves 107 of the rims 104 of the lid. The lid 14 is then ultrasonically welded to the main body 12 of the float. The lower edge 140 of rim 38 captures the lower flange 122 of the spring clip 16 against the bottom horizontal segment 78 of the mounting bracket 36. In this manner, the spring clip 16 is secured rigidly to the main body 12 and lid 14 of the carburetor float so that the carburetor float acts as a single integral unit to control the inlet valve to the float bowl. The upper edges of the divider walls are ultrasonically welded, in a similar manner, in the grooves of the divider rims of the lid.

The ultrasonic welding of the lid 14 to the main body 12 causes the areas, as represented by arrows 135, of the side walls (or divider walls) and the lid to fuse together to form a solid, airtight float with the individual cells of the float sealed from each other.

As shown in FIG. 20, the lid 14 is secured atop the main body 12 to form an airtight seal at 137, and thereby create a sealed, hollow pontoon of the carburetor float 10. Due to the manufacture of the carburetor float from thermoplastic material by the process of ultrasonic welding, a tight seal is formed at the juncture 137 of the body 12 and lid 14.

However, over a period of extended usage, the pressure levels and fluctuations within the fuel distribution system can cause fuel to leak through even the smallest of voids or imperfections in the solder joint of the carburetor float. In prior art carburetor floats, fuel in the float bowl leaks into the pontoon of the carburetor float, causing the interior chamber to fill with fuel. As a result, the buoyancy of the carburetor float is affected, and the carburetor float does not accurately control the fuel level in the float bowl.

In an aircraft engine, the fuel distribution system is of critical importance. Consequently, failure of the fuel distribution system can be catastrophic. With the carburetor float of the present invention, if a leak develops at the weld joint or in a wall of the carburetor float, only the cell formed at the leak is subject to fuel leakage. The remaining cells retain their airtight integrity, allowing the carburetor float to continue metering the flow of fuel into the float bowl.

Figure 21:
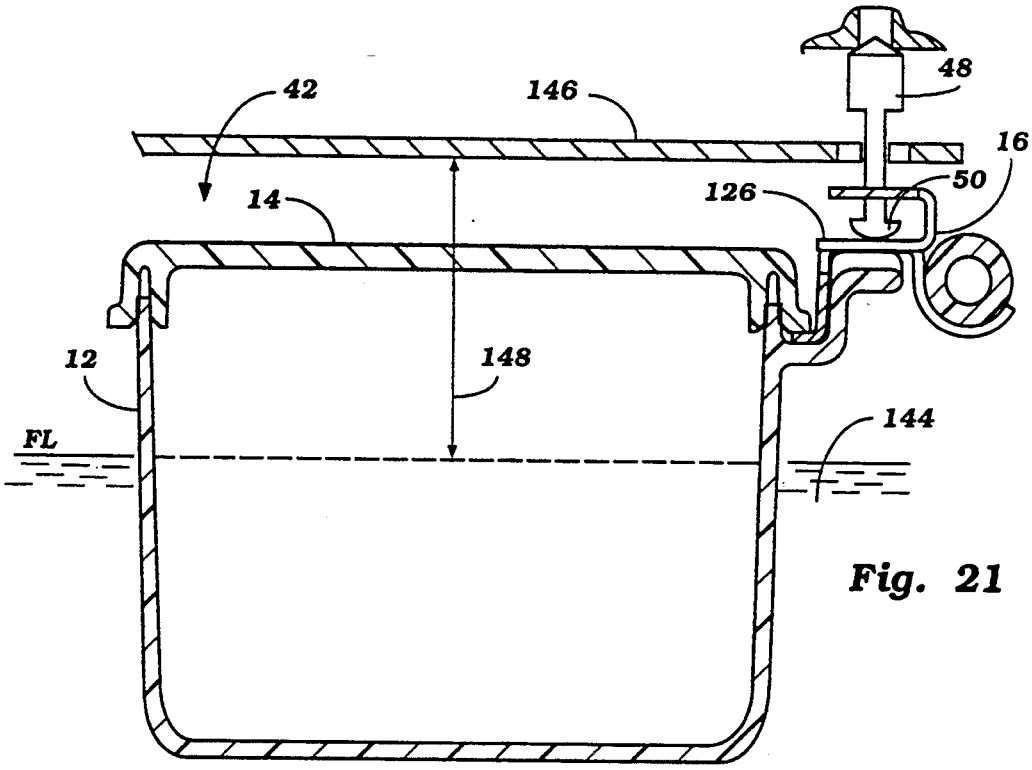
FIG. 21 is a cut-away side view of the pontoon of FIG. 2.
Figure 22:
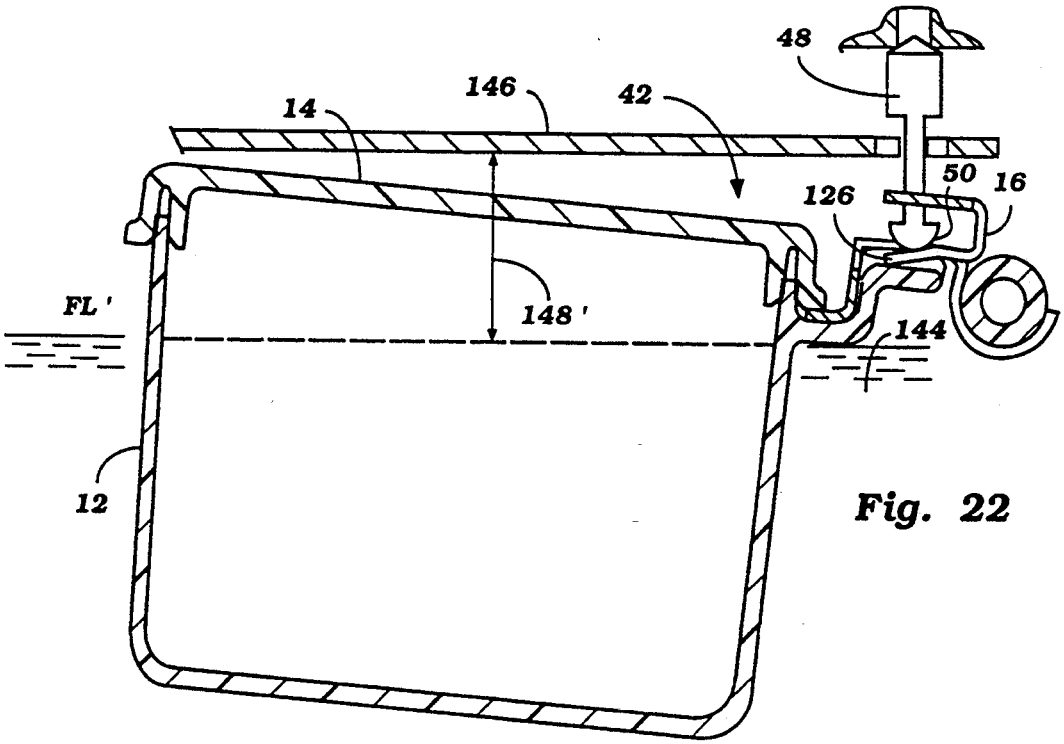
FIG. 22 is a cut-away side view of the carburetor similar to the view of FIG. 21 shown with the adjustable tab of the spring clip in an adjusted position.

FIGS. 21 and 22 illustrate the manner for adjusting the tab 126 of the spring clip 16. The adjustable tab 126 is the part of the spring clip 16 that engages the valve head 50 of the needle valve 48. In the position shown in FIG. 21, the needle valve 48 is in a closed position. The adjustable tab 126 is in a generally horizontal position. The carburetor float 10, likewise, is in a generally horizontal position, and part of the pontoon 12, 14 of the carburetor float is submerged within the fuel 144 in the float bowl 42 of the carburetor. In this position, a fuel level FL, as measured by the distance 148 between the fuel level FL and the top of the float bowl 146, is required to close the needle valve 48.

As shown in FIG. 22, adjustment of the tab 126 downwardly so that the tab is at an angle with respect to the spring clip 16 requires the fuel level FL' to rise in the float bowl 42 to a higher level, depicted by arrow 148', in order to close off fully the needle valve 48. Accordingly, adjustment of the tab 126 allows the fuel head within the float bowl to be controlled in accordance with the desired fuel head for the fuel discharge circuit.

FIGS. 21, 22 also illustrate the wear point between the needle valve head 50 and the adjustable tab 126. The stainless steel spring clip 16 substantially reduces the wear between the tab 126 and the needle valve head 50.

Figure 23:
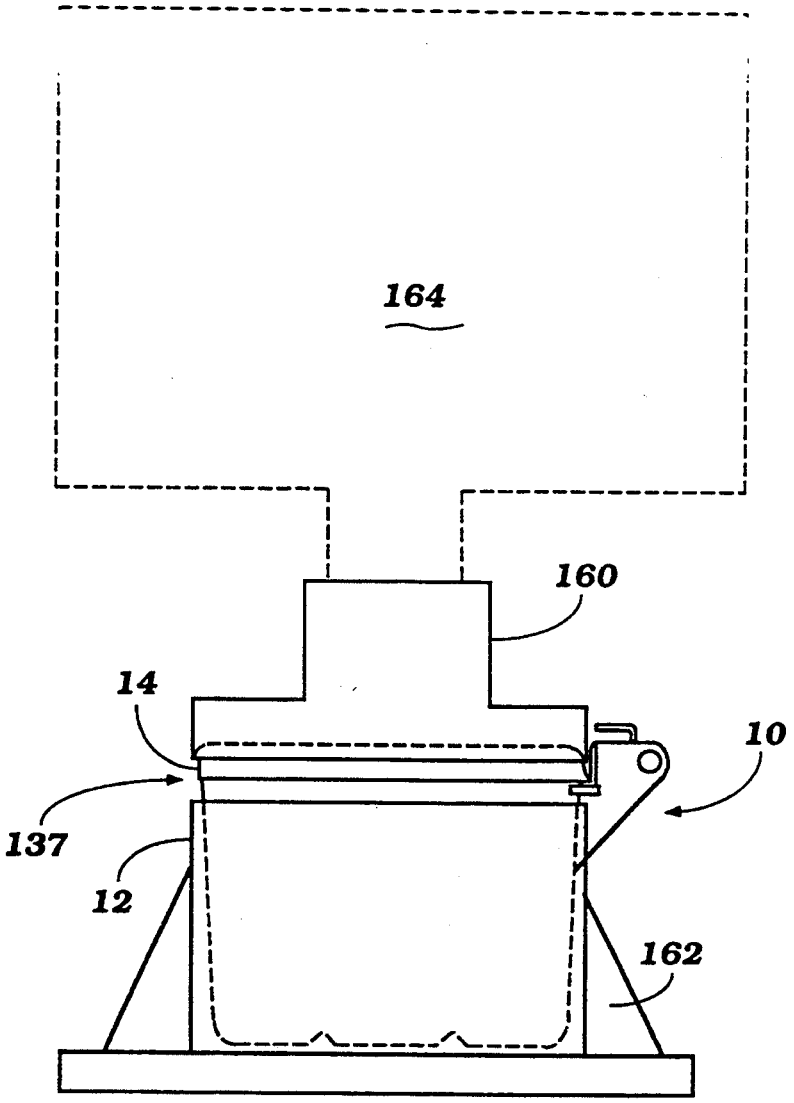
FIG. 23 is a schematic diagram illustrating the process for forming the pontoon of FIG. 1.

FIG. 23 is a schematic diagram illustrating the ultrasonic welding process for forming the carburetor float 10. The process of ultrasonic welding, generally, is well known and will only be discussed briefly herein. Ultrasonic welding of two thermoplastic parts requires that ultrasonic vibrations be transmitted through a horn 160 into the top half of the carburetor float assembly, which comprises the lid 14. The ultrasonic vibrations travel to the joint 137 or interface between the lid 14 and the main body 12 of the carburetor float 10. At the joint, vibratory energy is converted to heat, which melts and fuses the plastic. When the vibrations stop, the plastic solidifies under pressure producing a weld at the joining surfaces.

The main body 12 of the carburetor float 10 is supported by a fixture 162. The fixture 162 holds and aligns the main body 12 and lid 14 with the horn 160 while providing proper support to the assembly. An ultrasonic welder 164 generates an ultrasonic frequency, which is transmitted through the horn 160 and through the joint 137 between the lid 14 and main body 12 of the carburetor float.

Figure 24:
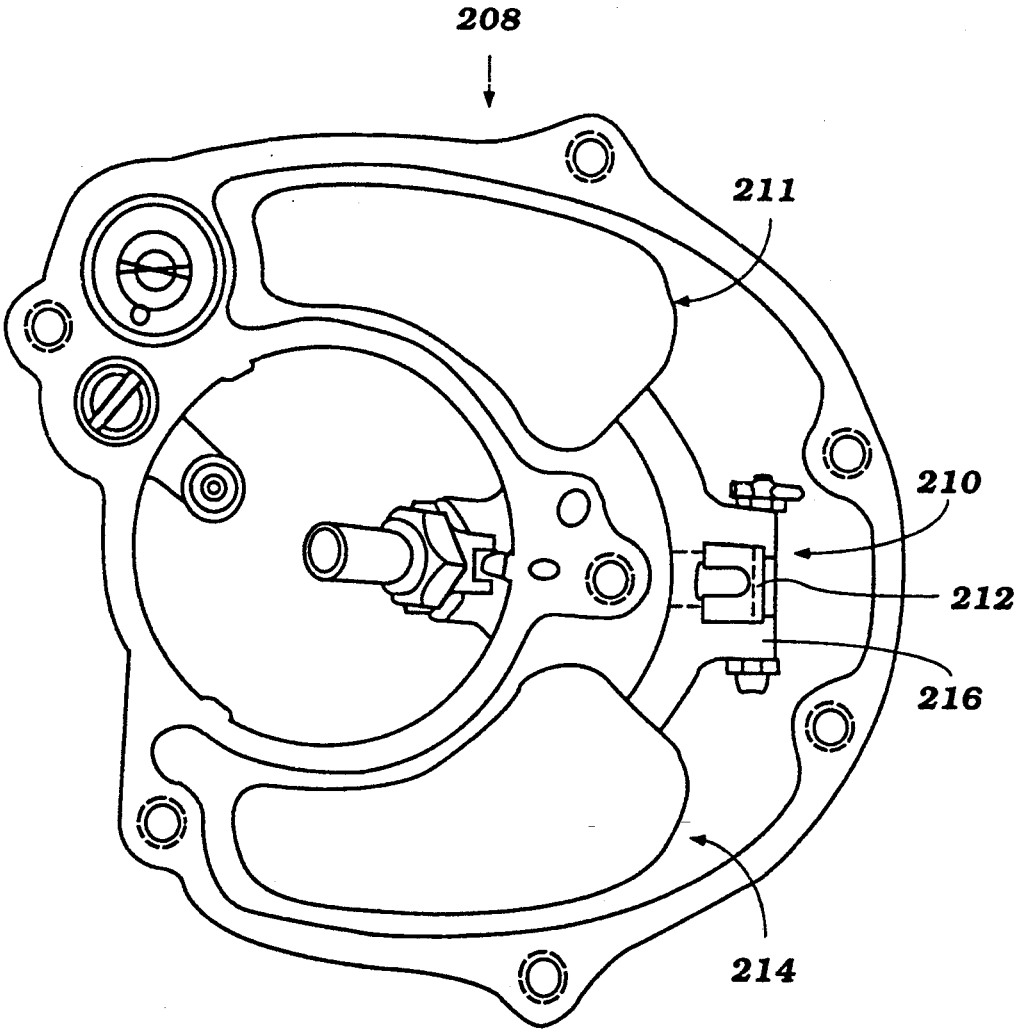
FIG. 24 is a top view of an alternative embodiment of the pontoon of FIG. 1 shown with the top of the carburetor removed.
Figure 25:
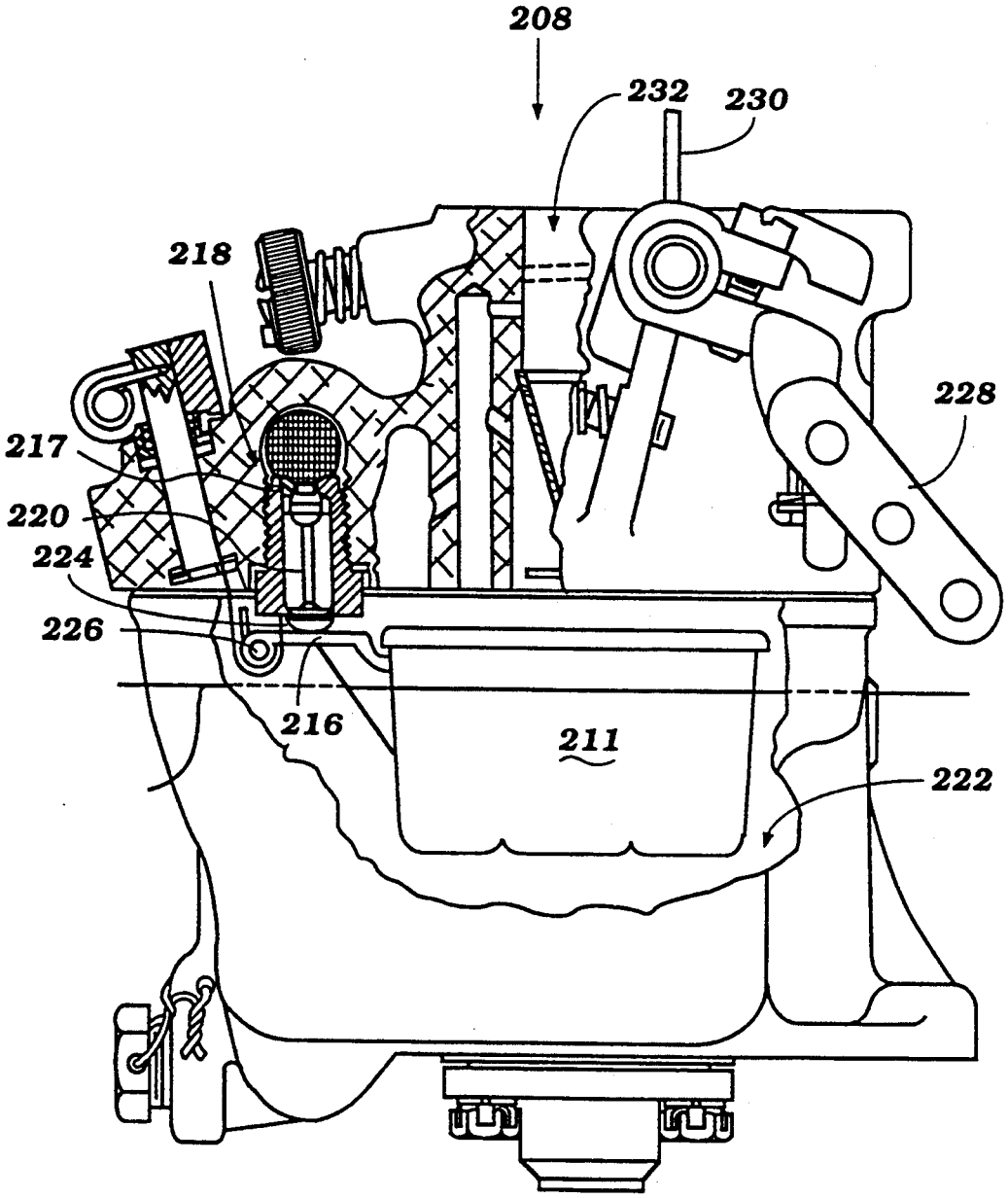
FIG. 25 is a side elevation view of the carburetor of Fig. 24, shown partially cut away.

FIG. 24 is a top view of an updraft carburetor 208 with the lid removed to illustrate a duel carburetor float arrangement. The carburetor float 210 includes a pair of pontoons 211, 214 coupled together by a Y-shaped spring clip 216. The upper clamp 212 of the spring clip 216 is configured similar to the upper clamp of the spring clip of FIGS. 14–18. Each pontoon 211, 214 is somewhat kidney shaped and includes a main body portion and a lid that are injection molded and ultrasonically welded together to form an airtight pontoon. FIG. 25 is a side elevation view of the carburetor 208 of FIG. 24. Fuel inlet 217 delivers fuel into fuel chamber 218. Needle valve 220 controls the flow of fuel into float bowl 222. Needle valve 220 includes a needle head 224 that engages spring clip 216. Pivot point 226 pivotally secures the carburetor float 211 within the float bowl 222. Throttle linkage 228 controls a throttle valve 230 in induction passage 232. Carburetor 208 is a Model MA45 manufactured by Precision Airmotive Corporation. FIGS. 24 and 25 illustrate one of many different types of carburetor float designs that may utilize a cellular pontoon arrangement in combination with a stainless steel spring clip and a thermoplastic mounting bracket, as described herein.

Accordingly, it can be seen that an improved carburetor float is provided that can continue to operate even when a leak forms in the pontoon of the carburetor float, and which is designed in a manner to mount to a stainless steel spring clip used to control a needle valve of a fuel inlet.

It is to be understood that many variations in size, shape, and construction can be made to the illustrated and above-described embodiment without departing from the spirit and scope of the present invention. Some of the features of the preferred embodiment may be utilized without other features. Therefore, it is to be understood that the presently described and illustrated embodiment is non-limitive and is for illustration only. Instead, my patent is to be limited for this invention only by the following claim or claims interpreted according to accepted doctrines of claim interpretation, including the doctrine of equivalence and reversal of parts.

What is claimed is:

1. A carburetor float for a carburetor that is part of a fuel delivery system in an internal combustion engine, the carburetor including a float bowl, a float-controlled valve extending into the float bowl for metering the flow of fuel into the float bowl, a fuel discharge fed by the float bowl, the carburetor float being pivotally secured in engagement with the float-controlled valve and being responsive to the level of fuel in the float bowl, the carburetor float comprising:

a hollow body defining a sealed interior chamber, the hollow body giving the carburetor float buoyancy so that the carburetor float rides at the level of the fuel in the float bowl and functions to control the opening and closing of the float-controlled valve in response to changes in the level of fuel in the float bowl, and a divider wall within the hollow body for dividing the interior chamber into at least two cells that are sealed from each other and from the fuel in the float bowl, whereby a leak in the hollow body will cause fuel in the float bowl to leak only into the one cell formed by that portion of the hollow body, while the other cell or cells remain sealed and the carburetor float continues to function to control the float-controlled valve;

wherein the hollow body of the carburetor float is formed by at least two pieces of formed plastic material that are sealed together; and wherein the two pieces of plastic material include flanges and a spring clip is clamped to the carburetor float between the two flanges of the two pieces of plastic material as they are welded together.

2. The carburetor float of claim 1, wherein the two pieces of plastic material are sealed together by a process of ultrasonic welding.

3. The carburetor float of claim 1, wherein the carburetor float includes a plurality of divider walls for dividing the interior float chamber into three or more sealed cells.

4. The carburetor float of claim 1, and further comprising a spring clip mounted to the hollow body for pivotally securing the carburetor float in engagement with the float-controlled valve.

5. The carburetor float of claim 4, wherein the spring clip is made of stainless steel.

6. The carburetor float of claim 4, wherein the spring clip includes an adjustable tab engageable with the needle valve.

7. The carburetor float of claim 4, and further comprising a second hollow body with a divider wall, wherein the spring clip mounts to both hollow bodies to form a dual-body carburetor float.

8. The carburetor float of claim 7, wherein the hollow bodies are kidney shaped to confirm to the interior dimensions of a rounded carburetor.

9. A carburetor float for a carburetor that is part of a fuel delivery system in an internal combustion engine, the carburetor including a float bowl, a float-controlled valve extending into the float bowl for metering the flow of fuel into the float bowl, a fuel discharge fed by the float bowl, the carburetor float being pivotally secured in engagement with the float-controlled valve and being responsive to the level of fuel in the float bowl, the carburetor float comprising:

a hollow body defining a sealed interior chamber, the hollow body giving the carburetor float buoyancy so that the carburetor float rides at the level of the fuel in the float bowl and functions to control the opening and closing of the float-controlled valve in response to changes in the level of fuel in the float bowl, and a divider wall within the hollow body for dividing the interior chamber into at least two cells that are sealed from each other and from the fuel in the float bowl, whereby a leak in the hollow body will cause fuel in the float bowl to leak only into the one cell formed by that portion of the hollow body, while the other cell or cells remain sealed and the carburetor float continues to function to control the float-controlled valve;

wherein the hollow body includes a mounting bracket including a plastic bushing for pivotally securing the carburetor float in the float bowl; and wherein the hollow body of the carburetor float is formed from a main body and a lid, and the mounting bracket is formed integral with the main body, and wherein the mounting bracket includes a bottom segment and the lid includes a flange, and a spring clip is mounted between the bottom segment and the flange.

10. The carburetor float of claim 9, wherein the mounting bracket includes a seat for the spring clip and a set of braces for supporting the seat.

11. The carburetor float of claim 9, wherein the hollow body of the carburetor float is formed by a main body portion and a lid that are sealed together.

12. A method of forming a carburetor float for a carburetor that is part of a fuel delivery system in an internal combustion engine, the carburetor including a float bowl, a float-controlled valve extending into the float bowl for metering the flow of fuel into the float bowl, a fuel discharge fed by the float bowl, the carburetor float being pivotally secured in engagement with the float-controlled valve and being responsive to the level of fuel in the float bowl, the method comprising the steps of:

injection molding a hollow body, defining an interior chamber, from thermoplastic material, the hollow body giving the carburetor float buoyancy so that the carburetor float rides at the level of the fuel in the float bowl and functions to control the opening and closing of the float-controlled valve in response to changes in the level of fuel in the float bowl, injection molding a lid for the hollow body from thermoplastic material, wherein the lid includes a peripheral groove and the hollow body includes a peripheral rim, the rim adapted to be received within the peripheral groove of the lid, the hollow body including a divider wall within its interior float chamber for dividing the chamber into at least two cells, the divider wall including a rim along its upper edge and the lid including a rib having a groove along its lower edge adapted to receive the rim of the divider wall, press fitting the lid onto the hollow body so that the grooves of the lid straddle the rims of the hollow body in a tongue-and-groove arrangement, and passing an ultrasonic frequency through the plastic material of the lid and hollow body, whereby the plastic material at the engagement of the lid and the rim of the hollow body is vibrated and heated, causing the plastic material to melt and form a welded seal between the lid and the rim; and wherein the step of injection molding the hollow body includes forming a spring clip retaining mount at the exterior side of the hollow body, and further comprising the step of positioning a spring clip on the spring clip retaining mount of the hollow body between the mount and the lid so that the welding of the lid to the hollow body securely clamps the spring clip to the carburetor float.

13. The method of claim 12, wherein the spring clip includes a bottom flange and the spring clip retaining mount includes a base and the spring clip is positioned on the retaining mount so that its flange is captured between the base of the retaining mount and the lid.

* * * * *